US006400915B2

(12) United States Patent
Nukada

(10) Patent No.: US 6,400,915 B2
(45) Date of Patent: Jun. 4, 2002

(54) TEMPERATURE CONTROLLED WET ELECTROPHOTOGRAPHIC APPARATUS

(75) Inventor: Hideki Nukada, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/810,487

(22) Filed: Mar. 19, 2001

(30) Foreign Application Priority Data

Mar. 30, 2000 (JP) ..... 2000-095525

(51) Int. Cl.[7] ..... G03G 15/00

(52) U.S. Cl. ..... 399/94; 399/97; 399/302; 399/308

(58) Field of Search ..... 399/94, 96, 97, 399/302, 308, 57, 92

(56) References Cited

U.S. PATENT DOCUMENTS 4,754,294 A 6/1988 Kato 5,428,432 A 6/1995 Mitani

FOREIGN PATENT DOCUMENTS

| | | | |
|---|---|---|---|
| EP | 1 079 281 | | 2/2001 |
| JP | 58-127958 | * | 7/1983 |
| JP | 01-200276 | * | 8/1989 |
| JP | 2-176674 | * | 7/1990 |
| JP | 10-268646 | | 10/1998 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

Disclosed is a wet electrophotographic apparatus, including a temperature measuring device configured to measure the temperature of the image holding surface of an electrophotographic photoconductor and/or the temperature of a liquid developer in a reservoir, a cooler configured to cool the liquid developer in the reservoir, and a controller. The controller controls the operation of the cooler based on the temperature measured by the temperature measuring device.

20 Claims, 5 Drawing Sheets

TEMPERATURE CONTROLLED WET ELECTROPHOTOGRAPHIC APPARATUS

CROSS-REFERENCE TO RELATED APPLICATIONS

This application is based upon and claims the benefit of priority from the prior Japanese Patent Application No. 2000-095525, filed Mar. 30, 2000, the entire contents of which are incorporated herein by reference.

BACKGROUND OF THE INVENTION

The present invention relates to an electrophotographic apparatus and a method of forming an image on a recording medium, particularly, to a wet electrophotographic apparatus and a method of forming a image ion a recording medium using a liquid developer.

In a wet electrophotographic technology, a liquid developer prepared by dispersing toner in a petroleum solvent is used, and an electrophoresis of the toner within the petroleum solvent is utilized in the developing process. The wet electrophotographic technology produces various merits that cannot be achieved in the dry electrophotographic technology and, thus, attracts attentions in this technical field in recent years.

For example, the wet electrophotographic technology permits using a very fine toner having a particle diameter of sub-micron order so as to make it possible to achieve a high image quality. Also, since it is possible to obtain a sufficiently high image density with a small amount of the toner, the wet electrophotographic technology is advantageous in economy. In addition, the wet electrophotographic technology permits realizing a texture fully comparable with that of the printing, e.g., an offset printing. Further, since the toner can be fixed to a paper sheet under a relatively low temperature, the energy saving can be achieved in the wet electrophotographic technology.

FIG. 1 schematically shows a conventional wet electrophotographic apparatus. In the conventional wet electrophotographic apparatus shown in FIG. 1, the image formation is performed as follows. In the first step, the image holding surface of a photoconductor drum 101, which is an electrophotographic photoconductor, is uniformly charged by a charger 102-1 while rotating the photoconductor drum 101 in the clockwise direction. Then, the charged image holding surface is exposed to a laser beam 103-1 modulated to conform with the image information of yellow. As a result, an electrostatic latent image conforming with the yellow image is formed on the image holding surface. Then, a yellow liquid developer is supplied from a developing device 104-1 onto the image holding surface having the electrostatic latent image formed thereon. As a result, a yellow developer image conforming with the electrostatic latent image is formed on the image holding surface.

The image holding surface having the yellow developer image formed thereon is charged by a charger 102-2 and, then, is exposed to a laser beam 103-2. Further, a magenta liquid developer is supplied from a developing device 104-2 onto the image holding surface. As a result, a magenta developer image is formed on the image holding surface in addition to the yellow developer image. Further, the image holding surface having the yellow and magenta developer images formed thereon is charged by a charger 102-3 and, then, is exposed to a laser beam 103-3. Still further, a cyan liquid developer is supplied from a developing device 104-3 onto the image holding surface. In the next step, the image holding surface is charged by a charger 102-4 and, then, exposed to a laser beam 103-4. Further, a black liquid developer is supplied from a developing device 104-4 onto the image holding surface. As a result, yellow, magenta, cyan and black developer images are formed on the image holding surface of the photoconductor drum 101.

The developer images of these four colors are transferred from the image holding surface onto an intermediate transfer roller 105 and, then, are further transferred from the intermediate transfer roller 105 onto a paper sheet 106. A pressure transfer system in which pressure is applied from a press roller 107 onto the intermediate transfer roller 105 via the paper sheet 106 is employed in the transfer of the developer image from the intermediate transfer roller 105 onto the paper sheet 106. The pressure transfer system is also employed for the transfer of the developer image from the photoconductor drum 101 onto the intermediate transfer roller 105. In this case, however, a contact pressure is applied from the intermediate transfer roller 105 to the photoconductor drum 101, and the intermediate transfer roller 105 is heated. Incidentally, the transfer system in which the intermediate transfer roller 105 is heated is disclosed in U.S. Pat. No. 5,570,173, the entire contents of which are incorporated herein by reference.

The present inventors have found that, in the wet electrophotographic apparatus shown in FIG. 1, a very high transfer efficiency can be achieved in the case where the relationship $T_d<T_g<T_r$ is satisfied among the temperature $T_d$ of the image holding surface of the photoconductor drum 101, the surface temperature $T_r$ of the intermediate transfer roller 105 and the softening temperature (glass transition temperature) $T_g$ of the toner contained in the liquid developer. Note that the term "softening temperature" denotes the temperature dividing the degree of fluidity of a material. To be more specific, under temperatures lower than the softening temperature, the plastic viscosity of the material is markedly low. However, under temperatures equal to or higher than the softening temperature, the material exhibits a prominent fluidity and is soft.

For example, in the case of using a liquid developer containing a toner having a softening temperature $T_g$ of 40° C., a very high transfer efficiency can be achieved, if the temperature $T_d$ of the image holding surface of the photoconductor drum 101 is lower than 40° C. and the surface temperature $T_r$ of the intermediate transfer roller 105 is higher than 40° C. The particular relationship can be achieved in general by heating the intermediate transfer roller 105 by the heater in the intermediate transfer roller 105.

However, in the conventional wet electrophotographic apparatus shown in FIG. 1, it is impossible to avoid the heat conduction from the intermediate transfer roller to the photoconductor drum 101, with the result that the heat is accumulated in the photoconductor drum 101. What should be noted is that, where the conventional wet electrophotographic apparatus having such a heater is used over a long period of time, it is possible for the temperature $T_d$ of the image holding surface of the photoconductor drum 101 to be elevated to a level substantially equal to the surface temperature $T_r$ of the intermediate transfer roller 105. For example, where the temperature $T_r$ is about 50° C. to 80° C., the temperature $T_d$ is considered to be elevated to reach about 40° C. to 70° C.

Where the image holding surface of the photoconductor drum 101 is heated to a high temperature, it is impossible to satisfy the particular relationship denoted by the inequality noted above, leading to a problem that the transfer efficiency of the developer image from the photoconductor drum 101 to the intermediate transfer roller 105 is markedly impaired.

What should also be noted is that, where the image holding surface of the photoconductor drum 101 is heated to a high temperature, the liquid developers in the developing devices 104-1 to 104-4 are also heated so as to evaporate the carrier solvent contained in the liquid developer. Since it is undesirable in terms of the environmental problem for the evaporated solvent to leak to the outside of the case of the electrophotographic apparatus, it is necessary to further arrange a special means for preventing the evaporated solvent from leaking to the outside of the electrophotographic apparatus. Also, in this case, an additional problem is generated that the cycle for replenishing the solvent is shortened.

In order to cope with these problems, it is conceivable to arrange, for example, a water-cooling type or an air-cooling type cooling mechanism inside the photoconductor drum 101 so as to maintain constant the temperature of the image holding surface. However, in the case of arranging a cooling mechanism inside the photoconductor drum 101, the electrophotographic apparatus is rendered bulky and complex in construction.

Also, where a water-cooling type cooling mechanism is arranged inside the photoconductor drum 101, it is necessary to recover and renew the cooling water periodically, with the result that much labor is required for the maintenance of the electrophotographic apparatus.

BRIEF SUMMARY OF THE INVENTION

An object of the present invention is to provide a wet electrophotographic apparatus and a method of forming an image on a recording medium capable of maintaining a high transfer efficiency even in the case where the apparatus is operated over a long time.

Another object of the present invention is to provide a wet electrophotographic apparatus and a method of forming an image on a recording medium capable of suppressing the evaporation of the carrier solvent contained in the liquid developer.

Still another object of the present invention is to provide a wet electrophotographic apparatus and a method of forming an image on a recording medium capable of cooling the image holding surface of the electrophotographic photoconductor and also capable of saving the labor required for the maintenance.

According to a first aspect of the present invention, there is provided a wet electrophotographic apparatus forming an image on a recording medium comprising an electrophotographic photoconductor having an image holding surface; a latent image forming unit configured to form an electrostatic latent image on the image holding surface; a developing unit configured to form a developer image on the image holding surface having the latent image formed thereon by using a liquid developer containing a carrier solvent and a toner dispersed in the carrier solvent, the developing unit comprising a reservoir configured to reserve the liquid developer, a container connected to the reservoir and configured to be supplied with the liquid developer from the reservoir, and a developer feeding surface arranged to be in contact with the liquid developer in the container and configured to move near the image holding surface with the liquid developer interposed therebetween so as to supply the liquid developer in the container onto the image holding surface; a transfer unit configured to transfer the developer image from the image holding surface onto the recording medium; a first temperature measuring device configured to measure a temperature of the image holding surface; a cooler configured to cool the liquid developer in the reservoir; and a controller connected to the first temperature measuring device and to the cooler and configured to compare a first temperature measured by the first temperature measuring device with a first set value which is equal to or lower than a softening temperature of the toner and control an operation of the cooler to lower the first temperature in a case where the first temperature is equal to or higher than the first set value.

According to a second aspect of the present invention, there is provided a wet electrophotographic apparatus forming an image on a recording medium, comprising an electrophotographic photoconductor having an image holding surface; a latent image forming unit configured to form an electrostatic latent image on the image holding surface; a developing unit configured to form a developer image on the image holding surface having the latent image formed thereon by using a liquid developer containing a carrier solvent and a toner dispersed in the carrier solvent, the developing unit comprising a reservoir configured to reserve the liquid developer, a container connected to the reservoir and configured to be supplied with the liquid developer from the reservoir, and a developer feeding surface arranged to be in contact with the liquid developer in the container and configured to move near the image holding surface with the liquid developer interposed therebetween so as to supply the liquid developer in the container onto the image holding surface; a transfer unit configured to transfer the developer image from the image holding surface onto the recording medium; a first temperature measuring device configured to measure a temperature of the liquid developer in the reservoir; a cooler configured to cool the liquid developer in the reservoir; and a controller connected to the first temperature measuring device and to the cooler and configured to compare a first temperature measured by the first temperature measuring device with a first set value which is equal to or lower than a softening temperature of the toner and control an operation of the cooler to lower the first temperature in a case where the first temperature is equal to or higher than the first set value.

According to a third aspect of the present invention, there is provided a method of forming an image on a recording medium comprising forming a latent image on a image holding surface of a electrophotographic photoconductor; forming a developer image on the image holding surface having the latent image thereon by supplying the image holding surface with a liquid developer containing a carrier solvent and a toner dispersed in the carrier solvent; transferring the developer image from the image holding surface onto the recording medium; setting a set value which is equal to or lower than a softening temperature of the toner; measuring a temperature of the image holding surface; comparing the temperature of the image holding surface measured with the set value; and cooling the liquid developer before supplying the image holding surface with the liquid developer in a case where the temperature of the image holding surface measured is equal to or higher than the set value.

According to a fourth aspect of the present invention, there is provided a method of forming an image on a recording medium comprising forming a latent image on a image holding surface of a electrophotographic photoconductor; forming a developer image on the image holding surface having the latent image thereon by supplying the image holding surface with a liquid developer containing a carrier solvent and a toner dispersed in the carrier solvent; transferring the developer image from the image holding surface onto the recording medium; setting a set value which is equal to or lower than a softening temperature of the toner; measuring a temperature of the liquid developer before supplying the image holding surface with the liquid developer; comparing the temperature of the liquid developer measured with the set value; and cooling the liquid developer before supplying the image holding surface with the liquid developer in a case where the temperature of the liquid developer measured is equal to or higher than the set value.

As described above, the liquid developer in the reservoir is cooled according to the first to forth aspects of the present invention. Where the liquid developer is cooled, it is possible to utilize the liquid developer as a coolant for cooling the image holding surface. Therefore, according to the first to forth aspects of the present invention, it is possible to maintain a high transfer efficiency even if the apparatus is continuously operated for a long time. Also, since the liquid developer is cooled, it is possible to prevent the toner deterioration and to suppress the evaporation of the carrier solvent. Further, since the liquid developer, which is a consumption article, is utilized as a coolant for cooling the image holding surface, the image holding surface can be cooled without requiring a much labor for the maintenance.

In the first to forth aspects of the present invention, it is desirable for the transfer unit to include an intermediate transferring member arranged near the electrophotographic photoconductor and configured to transfer the developer image from the image holding surface onto the recording medium. It is also desirable for the transfer unit to include a heater configured to heating the surface of the intermediate transferring member to a temperature higher than the softening temperature of the toner. The first to forth aspects of present invention are particularly effective in such a case.

In the first to forth aspects of the present invention, it is possible for the controller to be configured to compare the temperature of the image holding surface measured by the temperature measuring device with a set value which is, e.g., equal to or higher than the softening temperature noted above and control the operation of the apparatus to halt the printing in the case where the temperature of the image holding surface is higher than the set value.

In the first to forth aspects of the present invention, it is desirable for the controller to be configured to compare the temperature of the image holding surface measured by the temperature measuring device with a set value which is equal to or lower than the softening temperature of the toner and control the operation of the cooler to lower the temperature of the image holding surface. In this case, it is possible to achieve a particularly high transfer efficiency.

Where a temperature measuring device configured to measure the temperature of the liquid developer in the reservoir is arranged in the wet electrophotographic apparatus, it is possible to perform various controls based on the temperature of the liquid developer to be measured. For example, it is possible to set in advance a set value substantially equal to or higher than the softening temperature noted above in the controller. In this case, it is possible to judge whether or not it is necessary to renew the liquid developer by comparing the temperature of the liquid developer in the reservoir with the set value. It is also possible to set in advance a set value equal to or lower than the softening temperature noted above in the controller. In this case, it is possible to control the operation of the cooler based on the result obtained by comparing the temperature of the liquid developer in the reservoir with the set value. Where the operation of the cooler are controlled in this fashion, it is possible to make the temperature of the image holding surface lower than the softening temperature noted above. It is also possible to prevent deterioration of the liquid developer.

It is desirable for the wet electrophotographic apparatus according to the first to forth aspects of the present invention to further comprises a case configured to cover the above-noted constituents and a temperature measuring device arranged within the case which measures the temperature within the case. In this case, it is desirable to control the operation of the cooler such that the temperature of the liquid developer in the reservoir is rendered equal to or higher than a value which is equal to or calculated from the temperature within the case. By controlling the operation of the cooler in this fashion, it is possible to prevent the vapor within the case from being condensed into dew on the developing unit.

DETAILED DESCRIPTION OF THE INVENTION

Figure 1:
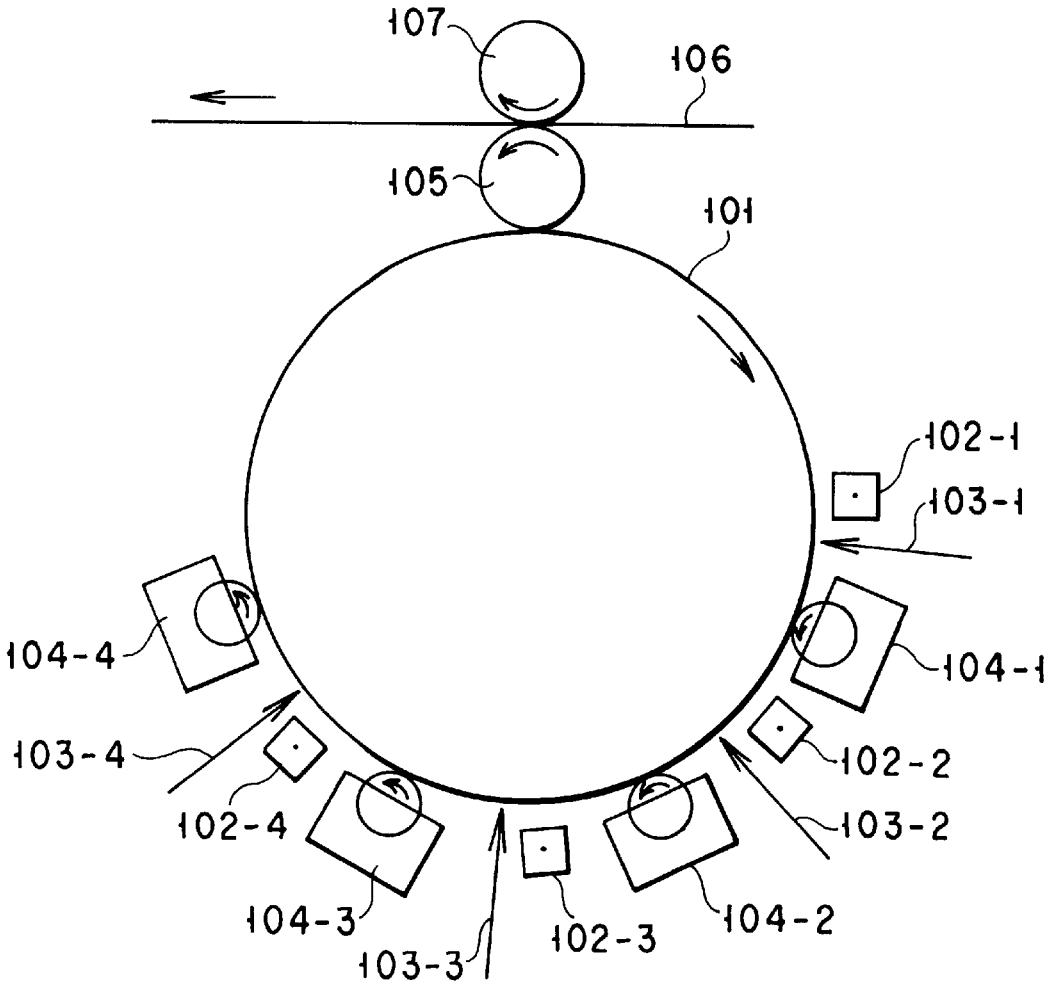
FIG. 1 PRIOR ART
FIG. 1 is a view schematically showing a conventional wet electrophotographic apparatus.

The present invention will now be described in detail with reference to the accompanying drawings. Throughout the drawings, the same or similar constituent elements are denoted by the same reference numerals so as to avoid an overlapping description.

Figure 2:
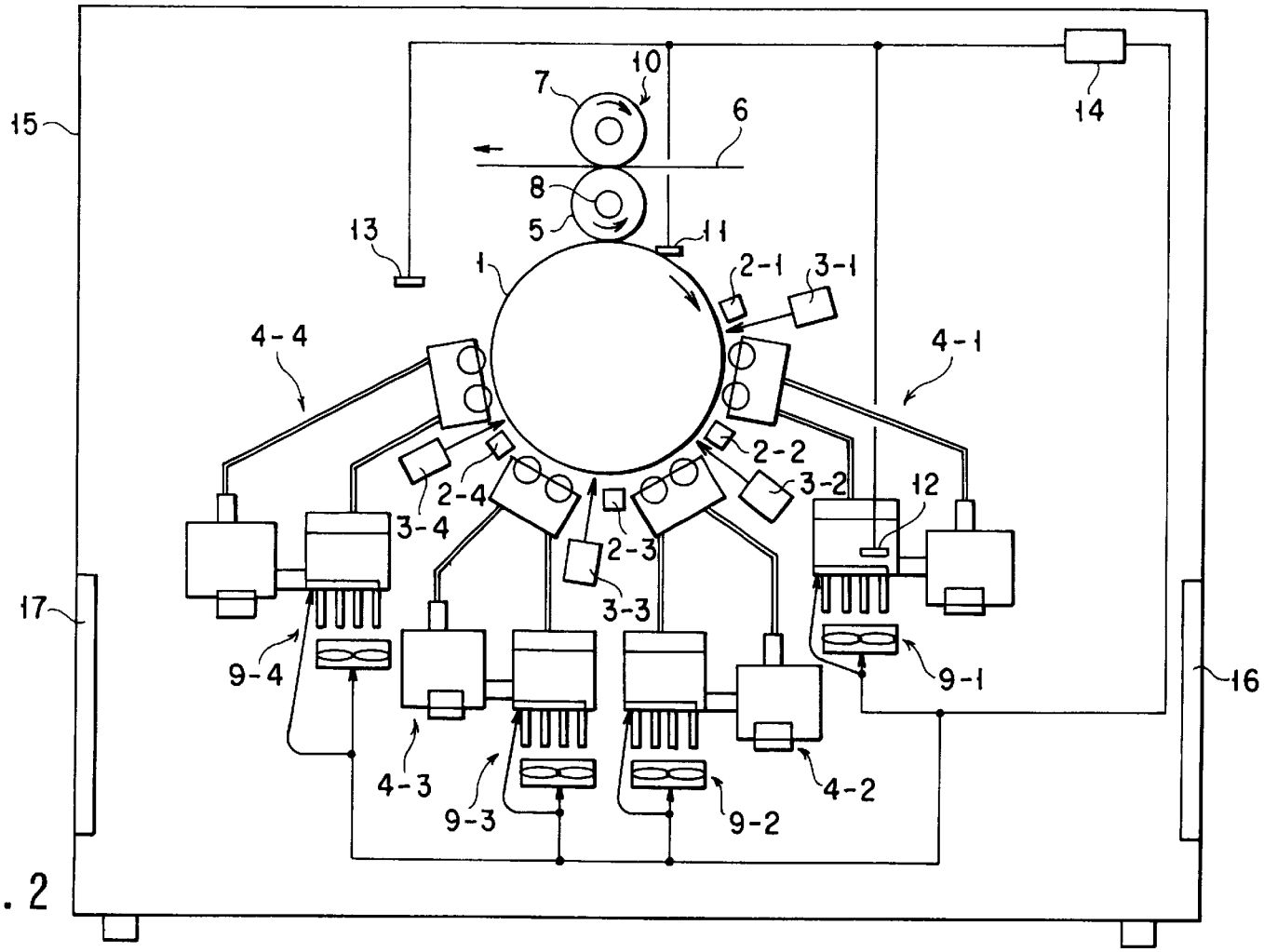
FIG. 2 is a view schematically showing a wet electrophotographic apparatus of full color type according to one embodiment of the present invention.

FIG. 2 schematically shows a wet electrophotographic apparatus of full color type according to one embodiment of the present invention. The electrophotographic apparatus shown in FIG. 2 has a photoconductor drum 1, which is an electrophotographic photoconductor. As shown in the drawing, chargers 2-n, light exposure devices 3-n and developing units 4-n corresponding to the yellow, magenta, cyan and black are arranged around the photoconductor drum 1. Also, a transfer unit 10 is arranged in the vicinity of the photoconductor drum 1. A case 15 is arranged to cover coolers 9-n, temperature measuring devices 11 to 13, and a controller 14 in addition to the chargers 2-n, the light exposure devices 3-n, the developing units 4-2 and the transfer unit 10. Incidentally, the case 15 is provided with ventilation ports 16 and 17. A ventilation fan is mounted to at least one of these ventilation ports 16 and 17.

The photoconductor drum 1 is in the form of a column and is driven by a driving mechanism (not shown) so as to be rotated at a constant speed in the clockwise direction. The surface parallel to the rotation axis of the photoconductor drum 1 constitutes an image holding surface. In accordance with rotation of the photoconductor drum 1, the image holding surface is moved relative to the charging devices 2-n, the light exposure devices 3-n, the developing units 4-n, and the transfer unit 10. The photoconductor drum 1 has a substrate, which has a conductive surface, and a photosensitive layer, e.g., an organic or amorphous silicon type photosensitive layer, formed on the conductive surface, the photosensitive layer being capable of change into a charged state upon light irradiation.

The chargers 2-n are, for example, corona chargers or scorotron chargers and permit uniformly charging the image holding surface of the photoconductor drum 1 in a positive or negative polarity. The light exposure devices 3-n, which include light sources such as lasers, permit the charged image holding surface to be irradiated with a light beam modulated in accordance with the image information for each color so as to form electrostatic latent images on the image holding surface. Each latent image forming unit is formed of each of these chargers 2-n and each of these light exposure devices 3-n.

The developing units 4-n are equal to each other in construction except that the kinds of the liquid developers used in these developing units 4-n differ from each other. Such being the situation, the yellow developing unit 4-1 alone is to be described concerning the developing units 4-n while omitting the description of the magenta developing unit 4-2, the cyan developing unit 4-3 and the black developing unit 4-4.

Figure 3:
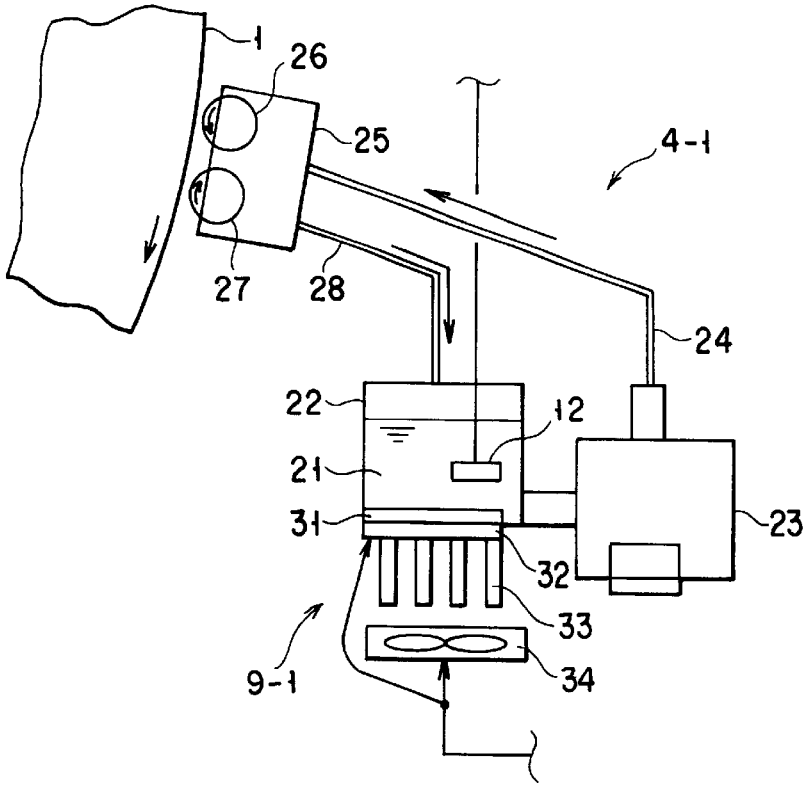
FIG. 3 is a magnified view of an example of the yellow developing unit included in the wet electrophotographic apparatus shown in FIG. 2.

FIG. 3 shows in a magnified fashion an example of the yellow developing unit 4-1 included in the wet electrophotographic apparatus shown in FIG. 2. The developing unit 4-1 has a reservoir 22 for reserving a yellow liquid developer. The reservoir 22 is connected to a pump 23, and the pump 23 is connected to a container 25 via a supply pipe 24. A developing roller 26 as a developer feeding member and a cleaning roller 27 are rotatably mounted to the container 25. Also, the container 25 is connected to the reservoir 22 via a discharge pipe 28.

A liquid developer 21, which is stored in the reservoir 22, contains a carrier solvent and a toner dispersed in the carrier solvent. In general, a petroleum solvent is used as the carrier solvent. Also, the toner particles are formed of, for example, a thermoplastic resin such as acrylic resin, styrene resin, polyester resin, epoxy resin, phenol resin, coumarone resin, xylene resin, vinyl chloride resin, and a polyolefin resin. These resins can be used singly or in the form of a mixture of at least two kinds of these resins. The toner contains a suitable colorant in addition to these thermoplastic resins. Further, it is possible for the toner to further contain an additive generally used in the electrophotographic technology.

The liquid developer 21 in the reservoir 22 is supplied through the supply pipe 24 into the container 25 by driving the pump 23. The developing roller 26, which is partially immersed in the liquid developer 21 supplied into the container 25, is arranged a slight distance apart, e.g., about 50 $\mu$m to 200 $\mu$m apart, from the photoconductor drum 1. The developing roller 26 is rotated in a counterclockwise direction in accordance with rotation of the photoconductor drum 1 in the clockwise direction so as to supply the liquid developer in the container 25 onto the image holding surface of the photoconductor drum 1.

In this step, a bias voltage of the polarity equal to the charged polarity of the toner is applied to the developing roller 26. Also, an electrostatic latent image is formed on the surface of the photoconductor drum 1 by the charger 2-1 and the light exposure device 3-1. It follows that an electric field is formed within the liquid developer positioned between the photoconductor drum 1 and the developing roller 26 so as to cause the toner to be migrated toward the photoconductor drum 1 by the electrophoresis. As a result, a developer image of a pattern conforming with the electrostatic latent image is formed on the image holding surface of the photoconductor drum 1.

It should be noted that a film of the solvent containing the toner that does not contribute to the formation of the developer image is formed on the image holding surface having the developer image formed thereon. The cleaning roller 27 serves to remove the film of the solvent from the image holding surface.

Like the developing roller 26, the cleaning roller 27 is also positioned slightly apart from the photoconductor drum 1. The solvent film is removed from the image holding surface of the photoconductor drum 1 by rotating the cleaning roller 27 in the clockwise direction while applying a bias voltage of the polarity opposite to the charged polarity of the toner. The solvent and the toner removed by the cleaning roller 27 from the image holding surface are scratched off by a blade (not shown) so as to be recovered in the container 25. The solvent and the toner recovered in the container 25 are brought back to the reservoir 22 through the discharge pipe 28. As described above, the developing unit 4-1 shown in FIG. 3 has a circulating mechanism for circulating the liquid developer 21 between the reservoir 22 and the container 25.

As shown in FIG. 2, the transfer unit 10 is constituted by an intermediate transfer roller 5, a press roller 7 and a heater 8 build in the intermediate transfer roller 5. The intermediate transfer roller 5 is arranged in contact with the image holding surface of the photoconductor drum 1 and is rotated in the counterclockwise direction in accordance with rotation of the photoconductor drum 1 in the clockwise direction. The press roller 7 is arranged in contact with the intermediate transfer roller 5 via a recording medium of a paper sheet 6 so as to apply pressure to the intermediate transfer roller 5. The press roller 7 is rotated in the clockwise direction in accordance with rotation of the intermediate transfer roller 5 in the counterclockwise direction. According to the transfer unit 10, the developer image formed on the image holding surface of the photoconductor drum 1 is transferred onto the surface of the intermediate transfer roller 5 heated to an appropriate temperature by the heater 8 by utilizing the contact force and the heat. The developer image transferred onto the surface of the intermediate transfer roller 5 is then transferred onto the paper sheet 6 by the pressure applied from the press roller 7.

The wet electrophotographic apparatus of this embodiment has coolers 9-n, temperature measuring devices 11 to 13 each provided with a temperature sensor such as a thermocouple or a radiation thermometer, and a controller 14. In this embodiment, these constituents of the apparatus permit preventing the image holding surface of the photoconductor drum 1 from being heated excessively and also permit suppressing the deterioration of the liquid developer.

The temperature measuring device 11 is arranged in contact with or slightly apart from the image holding surface of the photoconductor drum 1 so as to detect or measure the temperature of the image holding surface. As shown in FIG. 2, it is desirable for the temperature measuring device 11 to be arranged in the vicinity of the transfer unit 10.

As shown in FIG. 3, the temperature measuring device 12 is arranged in a manner to be immersed at least partially in the liquid developer 21 stored in the reservoir 22 of the developing unit 4-1 and serves to detect or measure the temperature of the liquid developer 21 within the reservoir 22. It is possible for the temperature measuring device 12 to be arranged in only the developing unit 4-1 or in all the developing units 4-n.

The temperature measuring device 13 is arranged within the case 15 so as to detect or measure the ambient temperature within the case 15. It is possible for a substantially hermetic second case covering the photoconductor drum 1, the chargers 2-n, the developing units 4-n, etc. to be arranged within the case 15. In this case, the temperature measuring device 13 is arranged within the second case.

The controller 14, which is connected to the temperature measuring devices 11 to 13 and to the coolers 9-n, serves to control the operation of the coolers 9-n based on the temperature detected or measured by the temperature measuring devices 11 to 13. Incidentally, the expression "to control the operation of the coolers 9-n" includes, for example, the idea of controlling the start-up and halt of the operation of the coolers 9-n and the idea of controlling the cooling efficiency by changing the electrical power supplied to the coolers 9-n. It is possible for the controller 14 to be further connected to the driving mechanism for driving the photoconductor drum 1, etc., the ventilation fan mounted to at least one of the ventilation ports 16 and 17, and the other device to which an electric power is supplied such as the heater 8. In other words, the controller 14 may be the one which serves to control not only the operation of the coolers 9-n but also the operation of the other devices. Incidentally, the expression "to control the operation of the device" includes the idea of controlling the start-up and halt of the operation of the device and the idea of controlling the electrical power supplied to the device.

It is possible for the coolers 9-n to be constructed as shown in, for example, FIG. 3. The cooler 9-1 shown in FIG. 3 includes a heat conductive plate 31, a Peltier element 32, a cooling fin 33 and a cooling fan 34. The heat conductive plate 31 is arranged, for example, to form a part of the wall of the reservoir 22. In this case, one main surface of the heat conductive plate 31 is in contact with the liquid developer in the reservoir 22. The Peltier element 32 is arranged on the other main surface of the heat conductive plate 31 so as to cool the liquid developer 21 in the reservoir 22 via the heat conductive plate 31. The cooling fin 33 is arranged on the back surface of the Peltier element 32. Also, the cooling fan 34 is arranged such that an air acting as a coolant is allowed to flow toward the cooling fin 33. The Peltier element 32 and the cooling fan 34 are connected to the controller 14.

It is possible for the coolers 9-2 to have various constructions. For example, it is possible for the coolers 9-n to be constructed as shown in FIG. 4.

Figure 4:
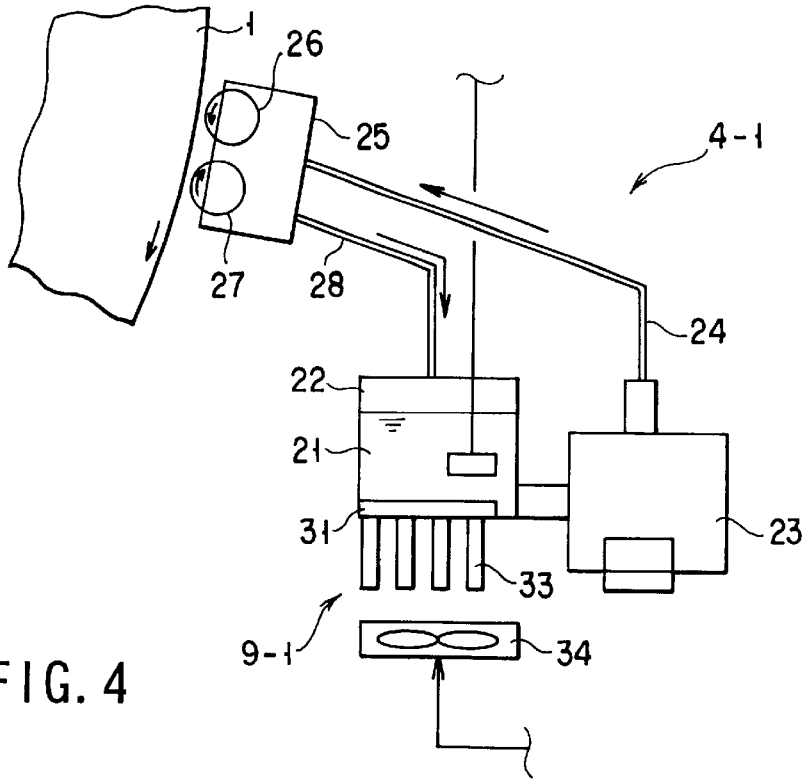
FIG. 4 is a magnified view of another example of the yellow developing unit included in the wet electrophotographic apparatus shown in FIG. 2.

FIG. 4 shows in a magnified fashion another example of the yellow developing unit 4-1 included in the wet electrophotographic apparatus shown in FIG. 2. The developing unit 4-1 shown in FIG. 4 is equal in construction to the developing unit 4-1 shown in FIG. 3, except that the developing units 4-1 shown in FIGS. 2 and 3 differ from each other in the construction of the cooler 9-1.

The cooler 9-1 shown in FIG. 4 has a heat conductive plate 31, a cooling fin 33 and a cooling fan 34. The heat conductive plate 31 is constructed to constitute a part of the wall of the reservoir 22, and one main surface of the heat conductive plate 31 is in contact with the liquid developer 21 stored in the reservoir 22. The cooling fin 33 is mounted to the other main surface of the heat conductive plate 31. The cooling fan 34 is connected to the controller 14 and is arranged such that an air acting as a coolant is allowed to flow toward the cooling fin 33. The cooler 9-1 shown in FIG. 4 differs from the cooler 9-1 shown in FIG. 3 in that the Peltier element 32 is not arranged in the cooler 9-1 shown in FIG. 4.

In the case of using the cooler 9-1 of the simplified construction as shown in FIG. 4, the performance of cooling the liquid developer 21 in the reservoir 22 is not so high as the case of using the cooler 9-1 shown in FIG. 3. However, the coolers 9-n of the simplified construction can be put to a practical use sufficiently in the case where a very high cooling power is not required. Also, the coolers 9-n of the simplified construction are advantageous in terms of the manufacturing cost.

The wet electrophotographic apparatus of the construction described above can be operated in various fashions. The printing process performed by the wet electrophotographic apparatus shown in FIG. 2 will now be described and, then, the typical operating method will be described.

If the power source of the wet electrophotographic apparatus shown in FIG. 2 is turned on, an electric power is supplied to the ventilating fan mounted to at least one of the ventilation ports 16 and 17, the heater 8, etc. After each device included in the electrophotographic apparatus is rendered ready for operation, the apparatus is in a waiting state.

When a command for start-up of the printing operation is inputted by the user under the waiting state of the apparatus, the photoconductor drum 1 begins to be rotated in the clockwise direction. In accordance with rotation of the photoconductor drum 1, the image holding surface of the photoconductor drum 1 is moved successively in front of each of the constituent elements arranged around the photoconductor drum 1. In the wet electrophotographic apparatus shown in FIG. 2, the printing process is executed under the state that the photoconductor drum 1 is rotated at a constant speed. Incidentally, the ventilation fan mounted to at least one of the ventilation ports 16 and 17 is kept driven as far as the power source is kept turned on.

When the image holding surface is moved in front of the charger 2-1, the light exposure device 3-1 and the developing unit 4-1, a yellow developing agent image is formed on the image holding surface. The image holding surface having the yellow developer image formed thereon is then allowed to be moved in front of the charger 2-2, the light exposure device 3-2 and the developing unit 4-2 so as to form a magenta developer image on the image holding surface. The image holding surface having the yellow and magenta developer images formed thereon is then moved in front of the charger 2-3, the light exposure device 3-3 and the developing unit 4-3 and, then, in front of the charger 2-4, the light exposure device 3-4 and the developing unit 4-4. As a result, cyan and black developer images are formed successively on the image holding surface having the yellow and magenta developer images formed thereon in advance. As a result, a full color developer image is formed on the image holding surface.

Then, the full color developer image is transferred from the photoconductor drum 1 onto the intermediate transfer roller 5 by utilizing pressure and heat. The developer image transferred onto the intermediate transfer roller 5 is further transferred onto the paper sheet 6 by utilizing pressure and/or heat. The paper sheet 6 having the developer image transferred thereonto is carried to the left in the drawing by a conveyor mechanism (not shown), thereby finishing the printing process.

In performing the printing process described above, the following control can be executed in the wet electrophotographic apparatus shown in FIG. 2.

Figure 5:
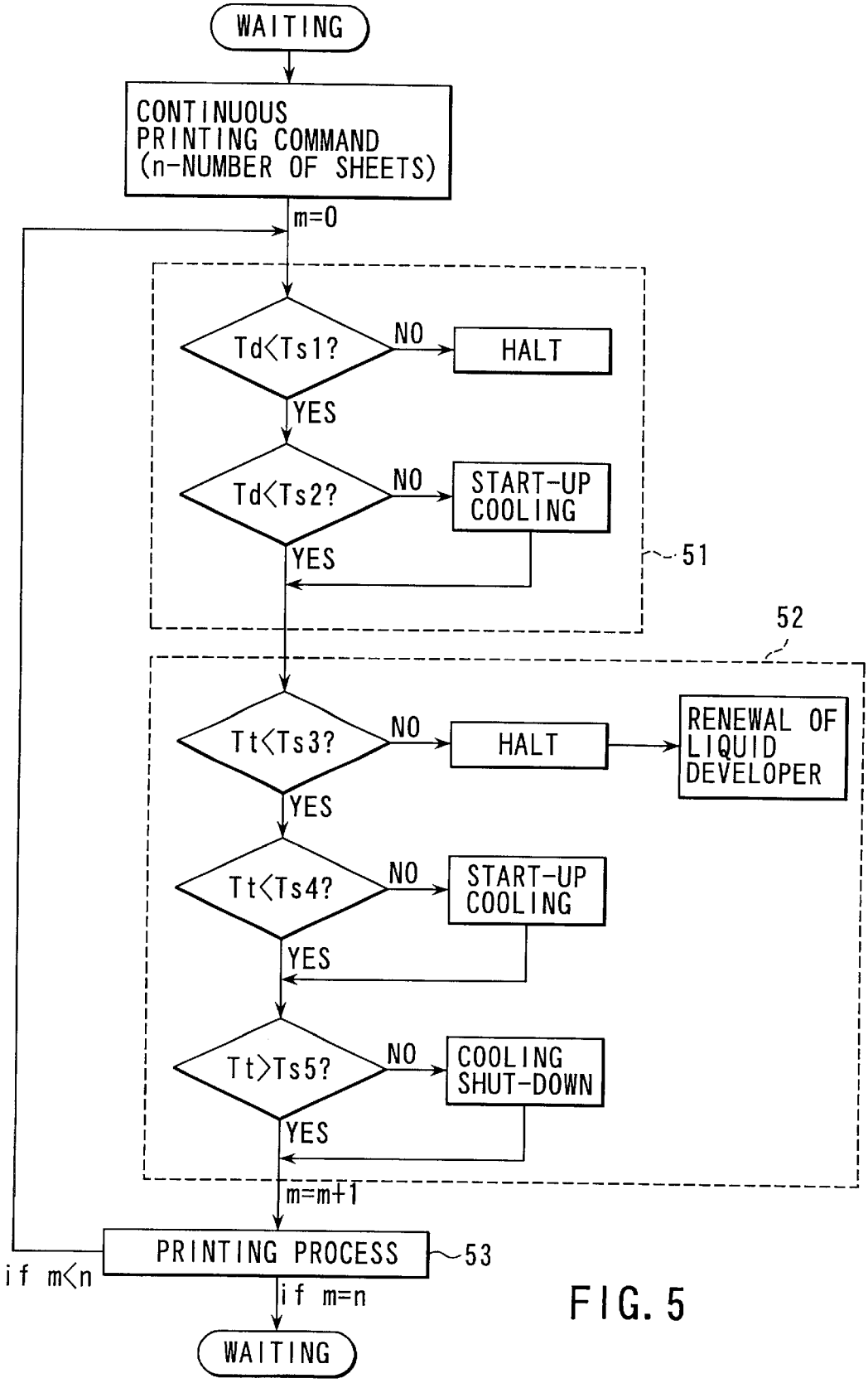
FIG. 5 is a flow chart showing a typical operating method of the wet electrophotographic apparatus shown in FIG. 2.

Specifically, FIG. 5 is a flow chart showing the typical operating method of the wet electrophotographic apparatus shown in FIG. 2. If an n-number of continuous printing command is inputted by a user to the apparatus under the waiting state, the printing cycle consisting of a first temperature control sequence 51, a second temperature control sequence 52 and a printing process 53 is repeated n-number of times, as shown in FIG. 5. As described herein later, the temperature control of the image holding surface of the photoconductor drum 1 is executed in the first temperature control sequence 51 mainly in an attempt to maintain a high transfer efficiency. On the other hand, the temperature control of the liquid developer is executed in the second temperature control sequence 52 mainly in an attempt to maintain the quality of the liquid developer and to prevent the dew formation.

In the first temperature control sequence 51, the temperature $T_d$ of the image holding surface of the photoconductor drum 1 measured by the temperature measuring device 11 is compared by the controller 14 with the set value $T_{s1}$ stored in the controller 14. Incidentally, the surface temperature $T_r$ of the intermediate transfer roller 5 is higher than the softening temperature (glass transition temperature) $T_g$ of the toner contained in the liquid developer. Also, the set value $T_{s1}$ is substantially equal to or lower than the softening temperature $T_g$. Where the temperature $T_d$ is not lower than the set value $T_{s1}$, the controller 14 temporarily stops or halts the printing cycle and cools the image holding surface of the photoconductor drum 1 until the temperature $T_d$ is rendered lower than the set value $T_{s1}$. The cooling of the image holding surface is performed in general by interrupting the printing cycle for a predetermined period of time with the ventilation fan kept driven. In this case, it is possible to stop the power supply to the heater 8 or to decrease the power supplied to the heater 8, if necessary.

In the case of performing such a control, the printing process is carried out only under the conditions meeting the inequality $T_d<T_g<T_r$. It follows that it is possible to perform the transfer of the developer image from the photoconductor drum 1 onto the intermediate transfer roller 5 with a high efficiency all the time.

Where the temperature $T_d$ is lower than the set value $T_{s1}$, the temperature $T_d$ is compared by the controller 14 with a set value $T_{s2}$ stored in the controller 14. Incidentally, the set value $T_{s2}$ is lower than the set value $T_{s1}$. In general, the set value $T_{s2}$ is lower by at least about 10° C. than the set value $T_{s1}$. Where the temperature $T_d$ is lower than the set value $T_{s2}$, the second temperature control sequence is, then, executed. On the other hand, where the temperature $T_d$ is not lower than the set value $T_{s2}$, the controller 14 supplies an electric power to the cooler 9-n so as to start the cooling of the liquid developer 21 in the reservoir 22, followed by executing the second temperature control sequence. The cooled liquid developer 21 is supplied to the image holding surface of the photoconductor drum 1 in the printing process so as to cool the image holding surface. The controller 14, which performs the control described above, serves to prevent the image holding surface of the photoconductor drum 1 from being heated to a temperature not lower than the set value $T_{s1}$.

In the printing cycle shown in FIG. 5, the second temperature control sequence is performed after the first temperature control sequence described above is performed. In the second temperature control sequence, the temperature $T_t$ of the liquid developer 21 measured by the temperature measuring device 12 is compared by the controller 14 with a set value $T_{s3}$ stored in the controller 14. Incidentally, the set value $T_{s3}$ is substantially equal in general to the softening temperature $T_g$ of the toner contained in the liquid developer 21. Where the temperature $T_t$ is not lower than the set value $T_{s3}$, the toner contained in the liquid developer 21 is considered to have been deteriorated. Therefore, in this case, the controller halts the printing cycle and allows an image and/or character denoting that it is necessary to renew the liquid developer to be displayed on a display screen (not shown). The printing cycle is started again after the renewal of the liquid developer has been finished.

Where the temperature $T_t$ is lower than the set value $T_{s3}$, the temperature $T_t$ is compared by the controller 14 with a set value $T_{s4}$ in the second temperature control sequence 52. The set value $T_{s4}$ is lower in general by at least about 5° C. than the set value $T_{s3}$.

Where the temperature $T_t$ is not lower than the set value $T_{s4}$, the controller 14 supplies an electric power to the coolers 9-n so as to start the cooling of the liquid developer 21 in the reservoir 22 and, then, performs the next control. By performing such a control, the controller 14 permits preventing the liquid developer in the reservoir 22 from being heated to a temperature not lower than the set value $T_{s3}$ . In other words, the toner contained in the liquid developer 21 is prevented from being deteriorated. On the other hand, where the temperature $T_t$ is lower than the set value $T_{s4}$, the controller 14 performs the next control without starting the cooling of the liquid developer 21. Incidentally, where the cooling is already started in the first temperature control sequence 51, the cooling is continued in any case.

It is desirable for the set value $T_{s4}$ to be lower than the set value $T_{s3}$ and to be a value capable of sufficiently suppressing the evaporation of the carrier solvent contained in the liquid developer from, for example, the container 25. In this case, it is possible to prevent the toner contained in the liquid developer 21 in the reservoir 22 from being deteriorated. In addition, it is possible to suppress the evaporation of the solvent contained in the liquid developer. It follows that it is possible to prevent effectively the deterioration of the liquid developer.

In the second temperature control sequence 52, the temperature $T_t$ is then compared by the controller 14 with a value $T_{s5}$. The value $T_{s5}$, which is lower than the set values $T_{s4}$ and $T_{s2}$, is a value changed in accordance with temperature $T_a$ within the case 15, which is measured by the temperature measuring device 13. For example, the value $T_{s5}$ can be a value calculated by a formula $(T_a-\alpha)$, where $\alpha$ is not larger than 2 and is preferably zero.

Where the temperature $T_t$ is higher than the value $T_{s5}$, the printing process 53 described above is executed. On the other hand, where the temperature $T_t$ is not higher than the value $T_{s5}$, the controller 14 stops the power supply to the coolers 9-n and, then, the printing process 53 is executed. In other words, the printing process 53 described above is executed after the cooling of the liquid developer 21 in the reservoir 22 is stopped. Where such a control is executed, the temperature of the liquid developer 21 in the reservoir 22 is not rendered excessively lower than the temperature $T_a$ within the case 15. As a result, it is possible to prevent the water vapor or the like within the case 15 from being condensed into dew on the surfaces of the developing units 4-n.

In the wet electrophotographic apparatus shown in FIG. 2, the first temperature control sequence 51, the second temperature control sequence 52 and the printing process 52 are executed for the every printing cycle. Therefore, according the wet electrophotographic apparatus shown in FIG. 2, it is possible to maintain a high transfer efficiency even in the case where the apparatus is continuously operated for a long time as in the case of a continuous printing. It is also possible to suppress the evaporation of the carrier solvent contained in the liquid developer. It should also be noted that, in the wet electrophotographic apparatus shown in FIG. 2, the liquid developer, which is an consumption article, is utilized as a coolant, making it possible to facilitate the maintenance. In other words, in the wet electrophotographic apparatus shown in FIG. 2, the image holding surface of the photoconductor drum 1 can be cooled without requiring a much labor for the maintenance.

In the operating method described previously with reference to FIG. 5, it is possible to supply the liquid developer from the reservoir 22 to the container 25 continuously or intermittently. Where the liquid developer is supplied intermittently, the supply of the liquid developer 21 from the reservoir 22 into the container 25 is started when, for example, the liquid developer 21 within the container 25 has become insufficient, and when the controller 14 has judged that it is necessary to cool the image holding surface of the photoconductor drum 1. Also, the supply of the liquid developer from the reservoir 22 into the container 25 is stopped when, for example, the container 25 has been filled with the liquid developer 21, and when the controller 14 has judged that it is unnecessary to cool the image holding surface of the photoconductor drum 1.

In the operating method described above, it is desirable for the temperature $T_t$ of the liquid developer 21 to be as low as possible unless the dew formation described above takes place. For example, it is desirable to cool the liquid developer such that the temperature $T_t$ is not higher than $(T_{a+}2)°$ C. In this case, the image holding surface of the photoconductor drum 1 can be cooled effectively.

According to the operating method described above, an electric power is kept supplied to the heater 8 in order to maintain constant the temperature of the intermediate transfer roller 5 during the waiting state of the apparatus. Naturally, the photoconductor drum 1 is also kept heated. Therefore, where the printing is not performed for a long time, it is possible for the image holding surface of the photoconductor drum 1 to be heated to a temperature not lower than the softening temperature $T_g$ of the toner. It follows that, where the printing is not performed for a predetermined period of time, it is desirable to cool the image holding surface by supplying the liquid developer 21 from the developing roller 26 onto the image holding surface while rotating the photoconductor drum 1 in order to prevent the temperature elevation of the image holding surface.

In the operating method described above, it is desirable to control the temperature $T_d$ of the image holding surface of the photoconductor drum 1 at about 30° C. to 40° C. in the case where the softening temperature $T_g$ of the toner is, for example, about 35° C. to 50° C. It is desirable to control the surface temperature $T_r$ of the intermediate transfer roller 5 at a level higher by about 40° C. to 50° C. than the temperature $T_d$. Further, it is desirable to control the temperature $T_t$ of the liquid developer 21 within the reservoir 22 at a level lower by at least 10° C. than the temperature $T_d$.

In the operating method described above, the order of executing the temperature control sequence 51, the temperature control sequence 52 and the printing process 53 is not particularly limited. For example, it is possible to execute the temperature control sequence 51 either before or after the temperature control sequence 52.

In the operating method described above, the temperature control sequence 51 and the temperature control sequence 52 are executed every time the printing process on a single paper sheet 6 is executed. However, it is also possible to execute the temperature control sequences 51 and 52 every time the photoconductor drum 1 makes one complete rotation. Further, it is possible to execute the printing process 53 and the temperature control sequences 51 and 52 in parallel.

In the operating method described above, the value $T_{s5}$ is a value that is changed in accordance with the temperature $T_a$ within the case 15. However, it is possible for the value $T_{s5}$ to be a set value stored in advance in the controller 14. In other words, it is not absolutely necessary to use the temperature measuring device 13. However, in the case of arranging the temperature measuring device 13, it is possible to cool the liquid developer 21 as low as possible within a range in which dew formation does not take place, making it possible to render the above-noted effect more prominent.

Also, in the operating method described above, the temperature control is carried out by utilizing both the temperature $T_d$ of the image holding surface of the photoconductor drum 1 and the temperature $T_t$ of the liquid developer 21 in the reservoir 22. However, it is possible to carry out the temperature control by utilizing only one of these temperatures $T_d$ and $T_t$. In other words, it is not absolutely necessary to arrange both of these temperature measuring devices 11 and 12. For example, it is possible to control the start-up and the halt of the cooling based on only the temperature $T_d$. Similarly, it is possible to control the start-up and the halt of the cooling based on only the temperature $T_t$. This is because the temperature $T_d$ of the image holding surface of the photoconductor drum 1 is related to the temperature $T_t$ of the liquid developer 21 in the reservoir 22. It should be noted, however, that, where the start-up and halt of the cooling is controlled on the basis of only one of the temperature $T_d$ and the temperature $T_t$, it is necessary to bear in mind that there is a time lag between the change in the temperature $T_d$ and the change in the temperature $T_t$.

Then, a continuous printing was performed by using the wet electrophotographic apparatus shown in FIG. 2 without performing the temperature control described above with reference to FIG. 5 so as to measure the temperature on the image holding surface of the photoconductor drum 1, the temperature on the surface of the intermediate transfer roller 5, and the temperature of the liquid developer 21 in the reservoir 22. Also, a continuous printing was performed by using the wet electrophotographic apparatus shown in FIG. 2 while executing the temperature control described above with reference to FIG. 5 so as to measure the temperature on the image holding surface of the photoconductor drum 1, the temperature on the surface of the intermediate transfer roller 5, and the temperature of the liquid developer 21 in the reservoir 22.

Figure 6A:
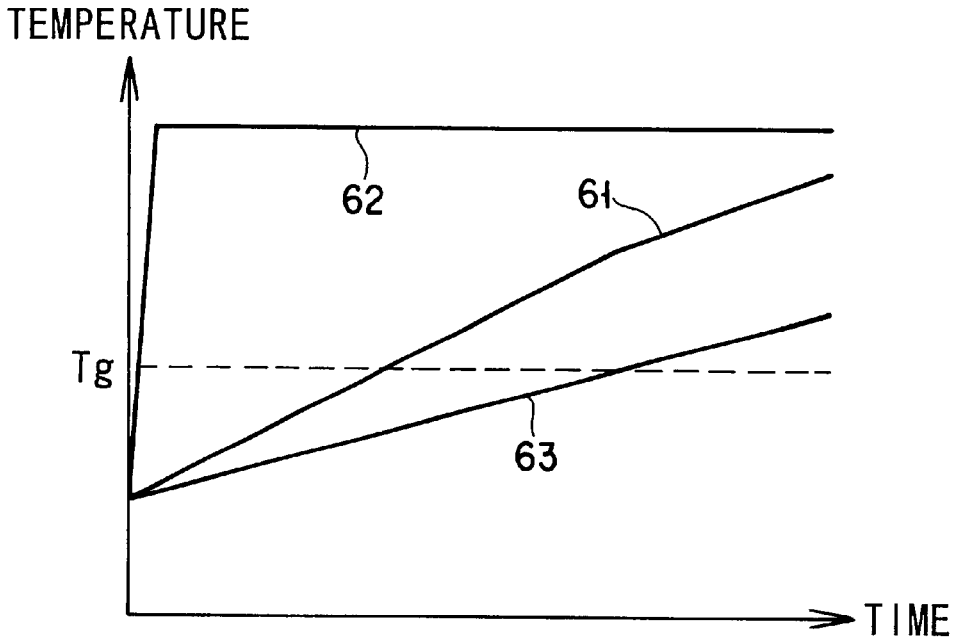
FIG. 6A is a graph showing the changes in temperature of the constituent elements, which are observed where the wet electrophotographic apparatus shown in FIG. 2 is operated by the conventional method.
Figure 6B:
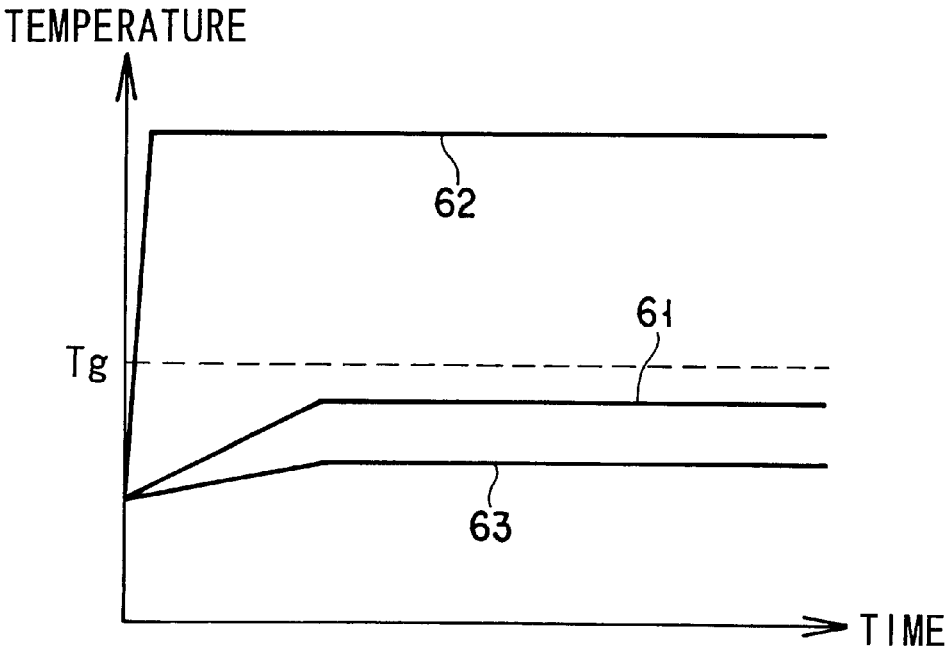
FIG. 6B is a graph showing the changes in temperature of the constituent elements, which are observed where the wet electrophotographic apparatus shown in FIG. 2 is operated by the method shown in FIG. 5.

FIG. 6A is a graph showing the change in temperature observed when the continuous printing was performed by the wet electrophotographic apparatus shown in FIG. 2 without executing the temperature control. On the other hand, FIG. 6B is a graph showing the change in temperature observed when the continuous printing was performed by the wet electrophotographic apparatus shown in FIG. 2 while executing the temperature control shown in FIG. 5. In each of these graphs, time is plotted on the abscissa, with the temperature being plotted on the ordinate. A solid line 61 shown in each of these graphs denotes the temperature on the image holding surface of the photoconductor drum 1. Another solid line 62 denotes the temperature of the intermediate transfer roller 5, with still another solid line 63 denoting the temperature of the liquid developer 21 in the reservoir 22. Further, a broken line shown in each of the graphs of FIGS. 6A and 6B denotes the softening temperature of the toner contained in the liquid developer.

As shown in FIG. 6A, the temperature on the image holding surface of the photoconductor drum 1 and the temperature of the liquid developer 21 in the reservoir 22 are increased with time in the case where the temperature control is not executed. As a result, the image holding surface and the liquid developer 21 are heated to temperatures higher than the softening temperature $T_g$. In other words, it is difficult to achieve a high transfer efficiency in the case where the temperature control is not executed.

On the other hand, FIG. 6B shows that, where the continuous printing is performed while executing the temperature control as shown in FIG. 5, the temperature on the image holding surface of the photoconductor drum 1 and the temperature of the liquid developer 21 in the reservoir 22 are held lower than the softening temperature $T_g$ even if the printing is performed for a long period of time. In other words, even if the printing is continuously performed for a long time, it is possible to maintain a high transfer efficiency and to prevent the liquid developer from being deteriorated.

As described above, in the present invention, the operation of the cooler can be controlled to permit the temperature of the image holding surface and the temperature of the liquid developer in the reservoir to be substantially equal to or lower than the softening temperature of the toner. Where the operation of the cooler are controlled in this fashion, it is possible to cool the image holding surface by utilizing the liquid developer. It follows that, according to the present invention, it is possible to maintain a high transfer efficiency even if the apparatus is continuously operated for a long period of time.

Also, in the present invention, the liquid developer is cooled, making it possible to suppress the evaporation of the carrier solvent contained in the liquid developer. It follows that, in the present invention, it is unnecessary to use a complex and costly mechanism required for preventing the diffusion of the solvent vapor. Also, since the evaporation of the carrier solvent is suppressed, the cycle for replenishing the carrier solvent is prolonged. Further, in the present invention, in which the evaporation of the carrier solvent is suppressed, the liquid developer within the reservoir is not excessively heated to a high temperature. It follows that, according to the present invention, it is possible to maintain a high quality of the liquid developer.

What should also be noted is that, in the present invention, the liquid developer, which is an consumption article, is utilized as a coolant for cooling the image holding surface. It follows that the image holding surface can be cooled without necessitating a much labor required for the maintenance. In addition, according to the present invention, it is more easy to miniaturize and simplify the wet electrophotographic apparatus, compared with the case where a cooling mechanism of a water-cooling type or an air-cooling type is arranged inside the photoconductor drum 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A wet electrophotographic apparatus forming an image on a recording medium, comprising:

an electrophotographic photoconductor having an image holding surface;

a latent image forming unit configured to form an electrostatic latent image on the image holding surface;

a developing unit configured to form a developer image on the image holding surface having the latent image formed thereon by using a liquid developer containing a carrier solvent and a toner dispersed in the carrier solvent, the developing unit comprising a reservoir configured to reserve the liquid developer, a container connected to the reservoir and configured to be supplied with the liquid developer from the reservoir, and a developer feeding surface arranged to be in contact with the liquid developer in the container and configured to move near the image holding surface with the liquid developer interposed therebetween so as to supply the liquid developer in the container onto the image holding surface;

a transfer unit comprising an intermediate transferring member adjacent to the image holding surface of the electrophotographic photoconductor and configured to transfer the developer image from the image holding surface onto the recording medium, and a heater configured to heat a surface of the intermediate transferring member to a temperature higher than the softening temperature of the toner;

a first temperature measuring device configured to measure a temperature of the image holding surface;

a cooler configured to cool the liquid developer in the reservoir; and a controller connected to the first temperature measuring device and to the cooler and configured to compare a first temperature measured by the first temperature measuring device with a first set value which is equal to or lower than a softening temperature of the toner and control an operation of the cooler to lower the first temperature in a case where the first temperature is equal to or higher than the first set value.

2. The wet electrophotographic apparatus according to claim 1, further comprising a second temperature measuring device configured to measure the temperature of the liquid developer in the reservoir;

wherein the controller is connected to the second temperature measuring device and configured to compare a second temperature measured by the second temperature measuring device with a second set value which is lower than the softening temperature of the toner and control the operation of the cooler to lower the second temperature in a case where the second temperature is equal to or higher than the second set value.

3. The wet electrophotographic apparatus according to claim 2, further comprising:

a case covering at least the electrophotographic photoconductor, the latent image forming unit, the developing unit, the transfer unit and the first temperature measuring device; and a third temperature measuring device arranged in the case and configured to measure a temperature within the case;

wherein the controller is connected to the third temperature measuring devices and configured to compare the second temperature with a third value which is equal to or calculated from a third temperature measured by the third temperature measuring device and control the operation of the cooler to stop lowering the second temperature in a case where the second temperature is equal to or lower than the third value.

4. The wet electrophotographic apparatus according to claim 1, further comprising:

a second temperature measuring device configured to measure the temperature of the liquid developer in the reservoir;

a case covering at least the electrophotographic photoconductor, the latent image forming unit, the developing unit, the transfer unit and the first temperature measuring device; and a third temperature measuring device arranged in the case and configured to measure a temperature within the case;

wherein the controller is connected to the second and the third temperature measuring devices and configured to compare a second temperature measured by the second temperature measuring device with a third value which is equal to or calculated from a third temperature measured by the third temperature measuring device and control the operation of the cooler to stop lowering the second temperature in a case where the second temperature is equal to or lower than the third value.

5. The wet electrophotographic apparatus according to claim 1, wherein the developing unit further comprises a circulating mechanism connected to the container and the reservoir and configured to circulate the liquid developer between the container and the reservoir.

6. The wet electrophotographic apparatus according to claim 1, wherein the cooler comprises at least one of a Peltier element and a cooling fan.

7. A wet electrophotographic apparatus forming an image on a recording medium, comprising:

an electrophotographic photoconductor having an image holding surface;

a latent image forming unit configured to form an electrostatic latent image on the image holding surface;

a developing unit configured to form a developer image on the image holding surface having the latent image formed thereon by using a liquid developer containing a carrier solvent and a toner dispersed in the carrier solvent, the developing unit comprising a reservoir configured to reserve the liquid developer, a container connected to the reservoir and configured to be supplied with the liquid developer from the reservoir, and a developer feeding surface arranged to be in contact with the liquid developer in the container and configured to move near the image holding surface with the liquid developer interposed therebetween so as to supply the liquid developer in the container onto the image holding surface;

a transfer unit comprising an intermediate transferring member adjacent to the image holding surface of the electrophotographic photoconductor and configured to transfer the developer image from the image holding surface onto the recording medium, and a heater configured to heat a surface of the intermediate transferring member to a temperature higher than the softening temperature of the toner;

a first temperature measuring device configured to measure a temperature of the liquid developer in the reservoir;

a cooler configured to cool the liquid developer in the reservoir; and a controller connected to the first temperature measuring device and to the cooler and configured to compare a first temperature measured by the first temperature measuring device with a first set value which is equal to or lower than a softening temperature of the toner and control an operation of the cooler to lower the first temperature in a case where the first temperature is equal to or higher than the first set value.

8. The wet electrophotographic apparatus according to claim 7, further comprising:

a case covering the electrophotographic photoconductor, the latent image forming unit, the developing unit, the transfer unit, the first temperature measuring device, the cooler, and the controller; and a second temperature measuring device arranged in the case and configured to measure a temperature within the case;

wherein the controller is connected to the second temperature measuring device and configured to compare the first temperature with a third value which is equal to or calculated from a second temperature measured by the second temperature measuring device and control the operation of the cooler to stop lowering the first temperature in a case where the first temperature is equal to or lower than the third value.

9. The wet electrophotographic apparatus according to claim 7, wherein the developing unit further comprises a circulating mechanism connected to the container and the reservoir and configured to circulate the liquid developer between the container and the reservoir.

10. The wet electrophotographic apparatus according to claim 7, wherein the cooler comprises at least one of a Peltier element and a cooling fan.

11. A wet electrophotographic apparatus forming an image on a recording medium, comprising:

an electrophotographic photoconductor having an image holding surface;

a latent image forming unit configured to form an electrostatic latent image on the image holding surface;

a developing unit configures to form a developer image on the image holding surface having the latent image formed thereon by using a liquid developer containing a carrier solvent and a toner dispersed in the carrier solvent, the developing unit comprising a reservoir configured to reserve the liquid developer, a container connected to the reservoir and configured to be supplied with the liquid developer from the reservoir, and a developer feeding surface arranged to be in contact with the liquid developer in the container and configured to move near the image holding surface with the liquid developer interposed therebetween so as to supply the liquid developer in the container onto the image holding surface;

a transfer unit configured to transfer the developer image from the image holding surface onto the recording medium;

a first temperature measuring device configured to measure a temperature of the image holding surface;

a cooler configured to cool the liquid developer in the reservoir;

a second temperature measuring device configured to measure a temperature of the liquid developer in the reservoir; and a controller connected to the first and second temperature measuring devices and to the cooler, configured to compare a first temperature measured by the first temperature measuring device with a first set value which is equal to or lower than a softening temperature of the toner and control an operation of the cooler to lower the first temperature in a case where the first temperature is equal to or higher than the first set value, and configured to compare a second temperature measured by the second temperature measuring device with a second set value which is lower than the softening temperature of the toner and control the operation of the cooler to lower the second temperature in a case where the second temperature is equal to or higher than the second set value.

12. The wet electrophotographic apparatus according to claim 11, further comprising:

a case covering at least the electrophotographic photoconductor, the latent image forming unit, the developing unit, the transfer unit and the first temperature measuring device; and a third temperature measuring device arranged in the case and configured to measure a temperature within the case;

wherein the controller is connected to the third temperature measuring device and configured to compare the second temperature with a third value which is equal to or calculated from a third temperature measured by the third temperature measuring device and control the operation of the cooler to stop lowering the second temperature in a case where the second temperature is equal to or lower than the third value.

13. The wet electrophotographic apparatus according to claim 11, wherein the developing unit further comprises a circulating mechanism connected to the container and the reservoir and configured to circulate the liquid developer between the container and the reservoir.

14. The wet electrophotographic apparatus according to claim 11, wherein the cooler comprises at least one of a Peltier element and a cooling fan.

15. A wet electrophotographic apparatus forming an image on a recording medium, comprising:

an electrophotographic photoconductor having an image holding surface;

a latent image forming unit configured to form an electrostatic latent image on the image holding surface;

a developing unit configured to form a developer image on the image holding surface having the latent image formed thereon by using a liquid developer containing a carrier solvent and a toner dispersed in the carrier solvent, the developing unit comprising a reservoir configured to reserve the liquid developer, a container connected to the reservoir and configured to be supplied with the liquid developer from the reservoir, and a developer feeding surface arranged to be in contact with the liquid developer in the container and configured to move near the image holding surface with the liquid developer interposed therebetween so as to supply the liquid developer in the container onto the image holding surface;

a transfer unit configured to transfer the developer image from the image holding surface onto the recording medium;

a first temperature measuring device configured to measure a temperature of the image holding surface;

a cooler configured to cool the liquid developer in the reservoir;

a second temperature measuring device configured to measure a temperature of the liquid developer in the reservoir;

a case covering at least the electrophotographic photoconductor, the latent image forming unit, the developing unit, the transfer unit and the first temperature measuring device;

a third temperature measuring device arranged in the ease and configured to measure a temperature within the ease; and a controller connected to the first, second and third temperature measuring devices and to the cooler, configured to compare a first temperature measured by the first temperature measuring device with a first set value which is equal to or lower than a softening temperature of the toner and control an operation of the cooler to lower the first temperature in a case where the first temperature is equal to or higher than the first set value, and configured to compare a second temperature measured by the second temperature measuring device with a third value which is equal to or calculated from a third temperature measured by the third temperature measuring device and control the operation of the cooler to stop lowering the second temperature in a case where the second temperature is equal to or lower than the third value.

16. The wet electrophotographic apparatus according to claim 15, wherein the developing unit further comprises a circulating mechanism connected to the container and the reservoir and configured to circulate the liquid developer between the container and the reservoir.

17. The wet electrophotographic apparatus according to claim 15, wherein the cooler comprises at least one of a Peltier element and a cooling fan.

18. A wet electrophotographic apparatus forming an image on a recording medium, comprising:

an electrophotographic photoconductor having an image holding surface;

a latent image forming unit configured to form an electrostatic latent image on the image holding surface;

a developing unit configured to form a developer image on the image holding surface having the latent image formed thereon by using a liquid developer containing a carrier solvent and a toner dispersed in the carrier solvent, the developing unit comprising a reservoir configured to reserve the liquid developer, a container connected to the reservoir and configured to be supplied with the liquid developer from the reservoir, and a developer feeding surface arranged to be in contact with the liquid developer in the container and configured to move near the image holding surface with the liquid developer interposed therebetween so as to supply the liquid developer in the container onto the image holding surface;

a transfer unit configured to transfer the developer image from the image holding surface onto the recording medium;

a first temperature measuring device configured to measure a temperature of the liquid developer in the reservoir;

a cooler configured to cool the liquid developer in the reservoir;

a case covering the electrophotographic photoconductor, the latent image forming unit, the developing unit, the transfer unit, the first temperature measuring device, the cooler and the controller;

a second temperature measuring device arranged within the case and configured to measure a temperature within the case; and a controller connected to the first and second temperature measuring devices and to the cooler, configured to compare a first temperature measured by the first temperature measuring device with a first set value which is equal to or lower than a softening temperature of the toner and control an operation of the cooler to lower the first temperature in a case where the first temperature is equal to or higher than the first set value, and configured to compare the first temperature with a third value which is equal to or calculated from a second temperature measured by the second temperature measuring device and control the operation of the cooler to stop lowering the first temperature in a case where the first temperature is equal to or lower than the third value.

19. The wet electrophotographic apparatus according to claim 18, wherein the developing unit further comprises a circulating mechanism connected to the container and the reservoir and configured to circulate the liquid developer between the container and the reservoir.

20. The wet electrophotographic apparatus according to claim 18, wherein the cooler comprises at least one of a Peltier element and a cooling fan.

* * * * *